US006925687B1

(12) United States Patent
Overton

(10) Patent No.: US 6,925,687 B1
(45) Date of Patent: Aug. 9, 2005

(54) BIB NAPKIN HOLDING CLIP

(76) Inventor: Benjamin E. Overton, 339 Bayview Ave., Ventura, CA (US) 93003

( * ) Notice: Subject to any disclaimer, the term of this patent is extended or adjusted under 35 U.S.C. 154(b) by 1 day.

(21) Appl. No.: 10/424,289

(22) Filed: Apr. 28, 2003

(51) Int. Cl.[7] ..... A45F 5/04
(52) U.S. Cl. ..... 24/7; 24/543
(58) Field of Search ..... 24/3.12, 3.1, 15, 24/7, 532, 542, 543, 545, 555, 570, 518, 24/517, 330

(56) References Cited

U.S. PATENT DOCUMENTS 3,604,071 A * 9/1971 Reimels ..... 24/543
3,616,497 A * 11/1971 Esposito, Jr. ..... 24/72.5
3,982,307 A * 9/1976 Smith et al. ..... 24/543
4,337,774 A * 7/1982 Perlin ..... 24/536
4,835,824 A * 6/1989 Durham et al. ..... 24/543
5,022,126 A * 6/1991 Davis ..... 24/543
5,159,730 A * 11/1992 Radvin ..... 24/543
5,305,502 A * 4/1994 Abrahams ..... 24/517
6,301,756 B1 * 10/2001 Howard ..... 24/552

* cited by examiner

*Primary Examiner*—Robert J. Sandy
(74) *Attorney, Agent, or Firm*—J. E. McTaggart

(57) ABSTRACT

A U-shaped clip seizes a bib napkin to a general region of the user's clothing that includes the chest and the lap, e.g. a shirt, sweater, blouse or suit coat. Optionally, a pair of clips may be utilized: one on each opposite edge or at the top and bottom of the napkin. The clip is molded from plastic and is configured with a pair of jaw pads operable by two push-buttons: a capture pushbutton that closes the jaw pads and latches them together with a choice of progressive steps of closure to allow for variations in contained cloth thickness, and a release pushbutton that releases the jaw pads for removal. Promotional printing such as a logo or other sponsor identification can be imprinted on exterior surfaces of the clip or one of the pushbuttons, particularly the release pushbutton which has three external facets that can be configured in a special shape and/or fitted with a promotional or decorative overlay part.

6 Claims, 3 Drawing Sheets

BIB NAPKIN HOLDING CLIP

FIELD OF THE INVENTION

The present invention relates to the field of clothing protection while eating and more particularly it relates to a holding clip for attaching a bib or table napkin to a selected area of a user's clothing.

BACKGROUND OF THE INVENTION

Bibs and napkins have a long history in the protection of clothing from discoloration and damage due to inadvertent food and/or liquid spillage. Bibs, usually associated with children, are customarily fitted with a pair of cloth strips to be tied around the back of the user's neck to support the bib high on the front chest region. Adult diners often use table napkins that, lacking provision for fastening, are customarily either placed on the lap and thus leave much chest area above unprotected, or else tucked into the neck region of the clothing, which is often impractical or at best inconvenient and subject to the napkin working loose, becoming misplaced or even falling to the floor.

DISCUSSION OF KNOWN ART

U.S. Pat. No. 5,913,478 to Ochsman discloses a WEARABLE CLAMP FOR RELEASEABLY HOLDING A NAPKIN OR OTHER FLEXIBLE SUBSTRATE AND METHOD FOR WEARING A NAPKIN OR OTHER FLEXIBLE SUBSTRATE. A single spring-loaded metal clip similar to a suspenders clasp with the addition of a rear spring clip for attachment to a central region of a clothing item such as a collar, shirt button or tie.

OBJECTS OF THE INVENTION

It is a primary object of the present invention to provide an improved method and associated attachment devices for conveniently attaching a regular table napkin to the user's clothing for full and reliable protection against spilled food or beverage.

It is a further object that the attachment devices be easily deployed and removed.

It is a further object that the devices be readily manufactured at low cost.

SUMMARY OF THE INVENTION

The foregoing objects have been met by the invention of a novel plastic clip that seizes the napkin to a region of the user's clothing, either in the region of the lap or of the chest, e.g. shirt, sweater, blouse or suit coat. Optionally, a pair of clips may be utilized: e.g. one on each opposite edge or top and bottom of the napkin.

The napkin clip is molded from plastic and is configured with a pair of jaw pads operable by a pair of pushbuttons: a capture pushbutton to close the jaw pad and latch them together with a choice two steps of closure to allow for variations in contained cloth thickness, and a release pushbutton for releasing the jaw pads for removal.

Promotional printing such a logo or other sponsor identification can be imprinted on exterior surfaces of the clip, particularly on the release pushbutton which can be made with any desired external shape and imprinted, or on an overlay part to be attached to the pushbutton.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
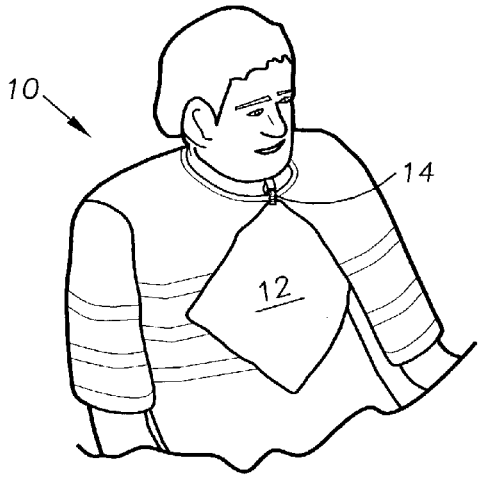
FIG. 1A is a perspective view showing a napkin clip of the present invention deployed in a first location on a user to hold a table napkin in place.

FIG. 1A is a perspective view showing the chest region of a user 10 protected by a table napkin 12 held in place by a napkin clip 14 of the present invention.

Figure 1B:
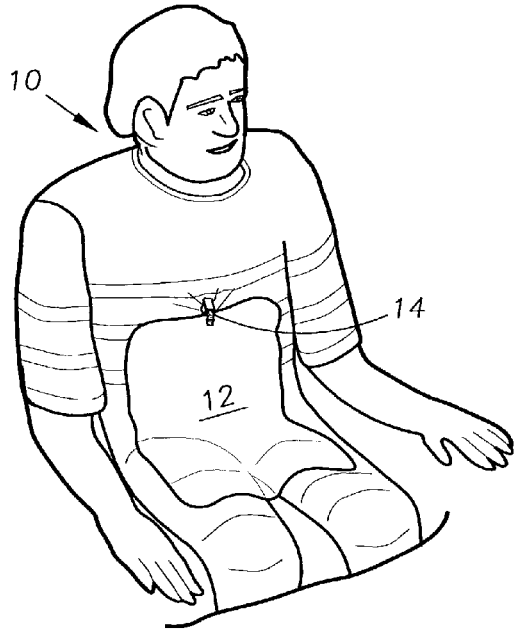
FIG. 1B is a perspective view showing a napkin clip of the present invention deployed in a second location on a user to hold a table napkin in place.

FIG. 1B is a perspective view as in FIG. 1A, but showing a lower frontal and lap region of the user 10 protected by a napkin 12 held in place by a napkin clip 14 of the present invention.

Figure 2:
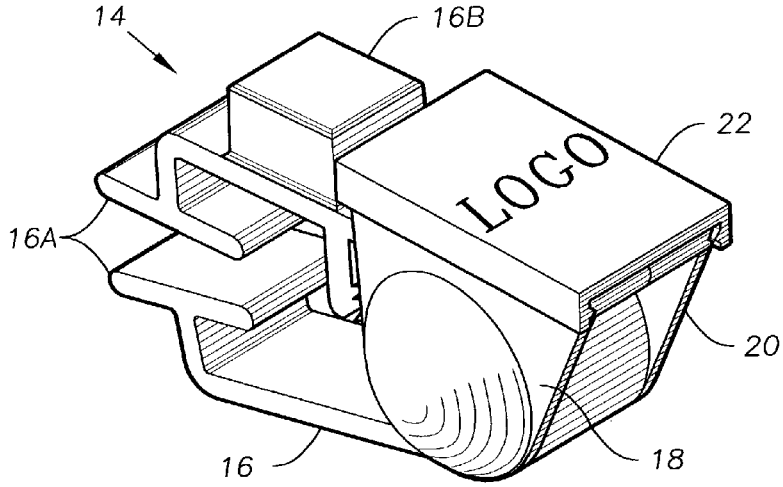
FIG. 2 is a perspective view of a napkin clip of the present invention as shown deployed in FIGS. 1A and 1B.

FIG. 2 is an enlarged perspective view of a napkin clip 14 as in FIG. 1, showing the main body member 16 with jaw pads 16A, capture pushbutton 16B and a release pushbutton assembly including side members 18 and 20 and release pushbutton cap 22, which may be imprinted with a promotional logo.

Figure 3:
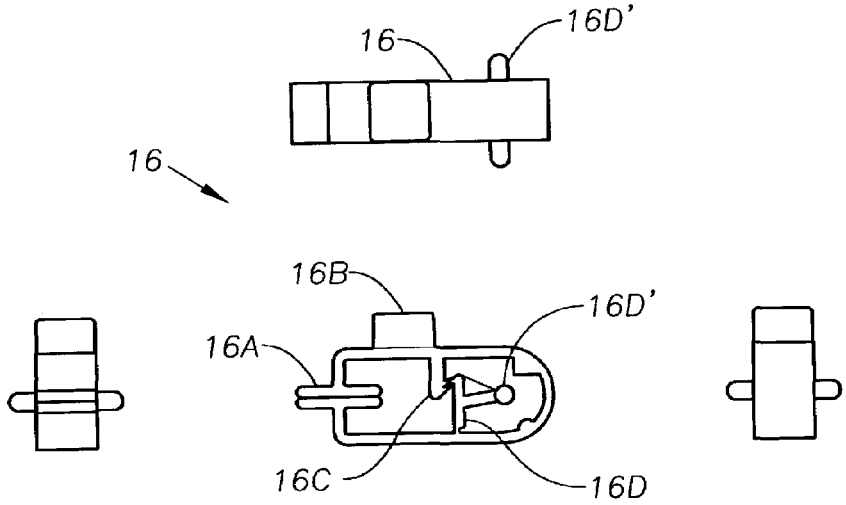
FIG. 3 is a set of four views of the main body member of the napkin clip of FIG. 2.

FIG. 3 is a set of four views of the main body member 16 of the napkin clip 14 of FIG. 2. The side view at center shows the main body member 16 with its pair of jaw pads 16A in the fully closed condition, as a result of depressing capture pushbutton 16B which is integrally molded as part of the main body member 16. Jaw pads 16A are held together in the closed condition shown due to a fixed latch member 16C extending down from the top of main body member 16, engaging a flex-mounted latch member 16D which is attached at the bottom by a thin strip so as to form a pivot point there by which the flex-mounted latch member 16D is in effect "spring" mounted.

A cantilevered arm, extending to the right from the main vertical body of flex-mounted latch member 16D, is configured with a pair of shaft ends 16D' that extend outwardly from the main body member 16 as shown to engage the side members 18 and 20 of the capture pushbutton assembly, as the linkage that enables depression of the release pushbutton to disengage the teeth of the latching members 16C and 16D, allowing the jaw pads 16A to snap open, driven by the resilient spring action of the main body 16.

The flex-mounted latching member 16D is originally formed and shaped in the molding process such that, when deployed by depression of capture pushbutton 16B, the flex-mounted latching member 16D is displaced, with spring bias holding it against the fixed latching member 16C, causing the teeth to engage as a pair of mating pawls which remain engaged when pushbutton 16B is released. In the absence of any external force applied, the inherent spring bias continues to hold latching member 16D against the fixed latching member 16C. This holding force, which may be further assisted by inclined plane action by configuring the interfacing teeth with a slight reverse angle, holds the clip 16 in the latched state until released by depressing the release pushbutton 22.

In this embodiment of the invention, two latching steps are provided by configuring the fixed latching member 16C with two teeth and configuring the flex-mounted latching member 16D with a single tooth. Alternatively, the two latching steps could be implemented by configuring latch member 16C with one tooth and latch member 16D with two teeth. As another alternative, three or more latching steps could be provided by configuring the latch members with additional teeth.

Figure 4:
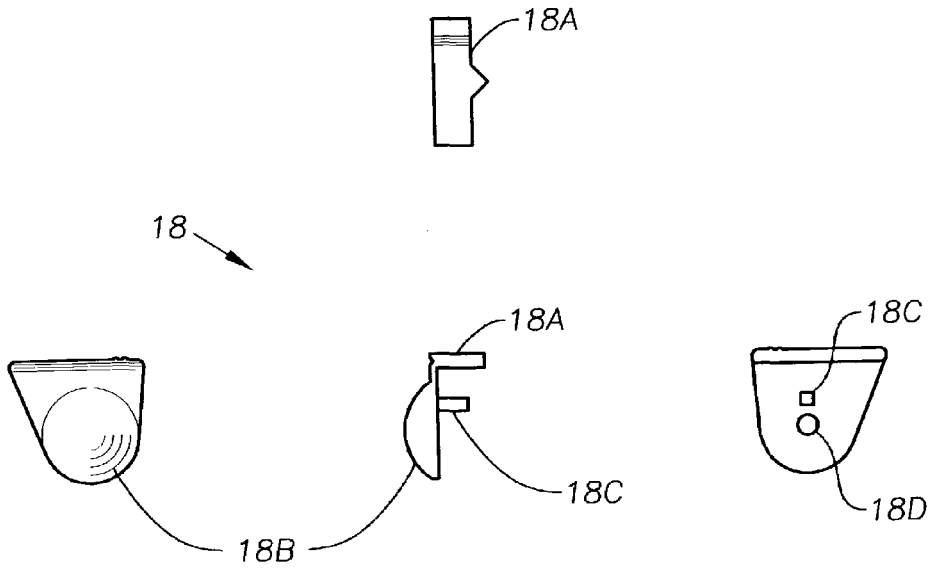
FIG. 4 is a set of four views of one of two side members of the release pushbutton assembly of the napkin clip of FIG. 2.

FIG. 4 is a set of four views of side member 18 of the capture pushbutton assembly of FIG. 2, showing a top flange 18A and a spherically shaped external side region 18B. The inner surface is configured with an extending stud 18C and a central recess 18D, dimensioned to accept shaft end 16D' (FIG. 3). The opposite side member 20 (FIG. 2) is substantially a mirror image of side member 18, except that member 20 is configured with a V-shaped notch (see FIG. 9) that conforms in a complementary manner to fit into the V-shaped protrusion seen on the top flange 18A of side member 18.

Figure 5:
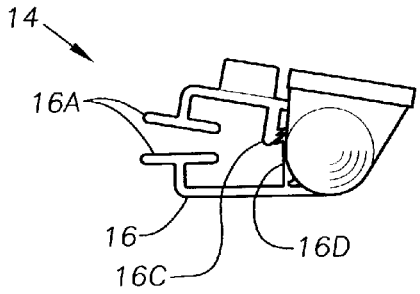
FIGS. 5–7 depict the three operating conditions of the napkin clip of FIGS. 1 and 2.
Figure 6:
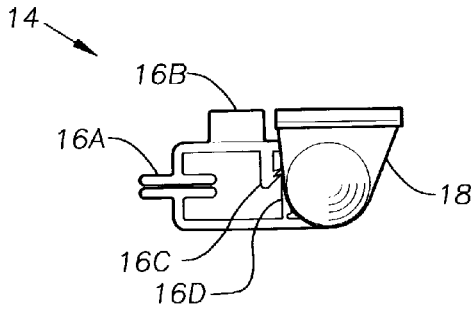
Figure 7:
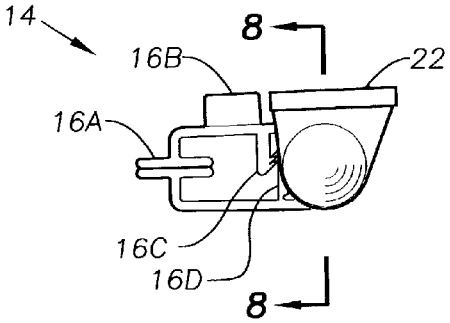

FIGS. 5–7 depict the three operating conditions of this preferred embodiment of the napkin clip of FIGS. 1–4.

FIG. 5 shows a side view napkin clip 14 in its open condition, i.e. in standby mode, with jaw pads 16A fully separated as shown; this is the unstressed condition in which the main member 16 is originally molded from plastic such as polypropylene that provides resilient flexibility, i.e. springiness, especially in a thin portion of the curved region at the right hand side of main member 16 (refer to FIG. 3).

FIG. 6 shows napkin clip 14 as in FIG. 5 but with jaw pads 16A held in a partially closed deployed condition, capture pushbutton 16B having been depressed to engage the first latching step of latching members 16C and 16D, for holding a relatively thick fold of napkin and clothing.

FIG. 7 shows napkin clip 14 as in FIGS. 5 and 6 but with jaw pads 16A held in the fully closed deployed condition, capture pushbutton 16B having been depressed to engage the second latching step of latching members 16B and 16C, for holding a relatively thin fold of napkin and clothing.

From either deployed condition of FIG. 6 or FIG. 7, the closure of napkin clip 14 may be released by depressing release pushbutton 22, which moves flex-mounted latching member 16D away from fixed latching member 16C, causing the clip 14 to immediately disengage and revert to the standby mode: i.e. the open condition shown in FIG. 5, i.e. the standby mode.

Figure 8:
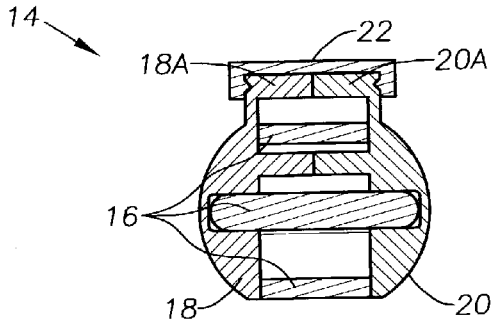
FIG. 8 is an enlarged cross-section taken through 8—8 of FIG. 7

FIG. 8 is a 2× enlarged cross-section of napkin clip 14 taken at 8—8 of FIG. 7 showing the spherical shape of the side members 18 and 20 assembled together with the main body member 16, with release pushbutton cap 22 assembled onto flanges 18A and 20A of side members 18 and 20. A complementary V-shaped guide configuration, seen at the interfaces of the top of side members 18, 20 and the inside of edge flanges of cap 22, retains cap 22 in place following sliding longitudinally into place in initial assembly.

Figure 9:
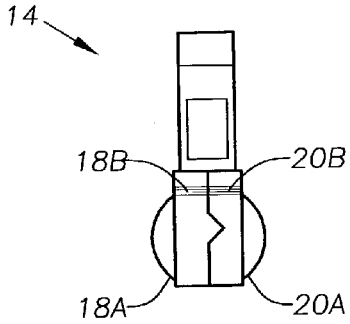
FIG. 9 is a top view of the napkin clip of FIG. 7 with the release pushbutton cap removed.

FIG. 9 is a top view of the napkin clip 14 of FIGS. 7–8 with the release pushbutton 22 removed to show the complementary joint configuration between the top flanges 18A and 18B of the side members, and a group of ridges 18B and 20B that engage similar ridges on cap 22 to secure cap 22 against further sliding displacement after initial assembly.

Figure 10:
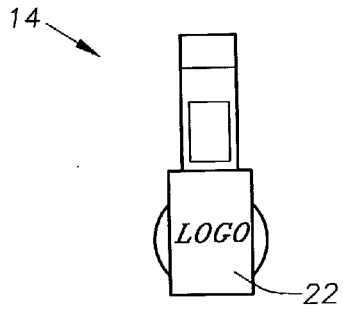
FIG. 10 is a top view of the napkin clip of FIG. 7 with the release pushbutton cap in place.

FIG. 10 is a top view of the napkin clip 14 of FIGS. 7–8 with the release pushbutton 22 assembled in place as described above in connection with FIG. 8. The relatively large rectangular surface of pushbutton cap 22 provides an ideal location for promotional text or graphics.

As an alternative to the rectangular shape of release pushbutton cap 22 shown in FIG. 10, this could made in a variety of external shapes while keeping the internal shape structurally compatible with the side members 18 and 20, either as originally molded as an integral part or by attachment of a promotional or decorative overlay part of any suitable material in any desired shape.

As an alternative to providing two latched positions in the deployed mode as described above, the invention could be practiced with only a single latched position by providing an increased degree of resilience in the main body member, or with more than two latched positions by providing a greater number of teeth on latching members 16C and 16D.

As an alternative to attaching a table napkin to the clothing with a single holding clip of the present invention, it may be attached with two or more clips, e.g. one at top and one at bottom, or one at each side in an upper region.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A napkin holding clip comprising:

a main body having a U-shaped cross-section with two substantially parallel linear arm portions extending from a curved portion of the U-shape to corresponding arm-ends located at an open end thereof;

a pair of jaw pads, disposed each at a corresponding one of two arm-ends, interfacing each other;

the main body being molded from plastic material and configured so as to be relatively rigid in the linear arm portions and relatively resilient in the curved portion, and formed such that, in an unstressed condition corresponding to a standby mode, the jaw pads are made to be sufficiently separated to allow insertion there between of a folded portion of the table napkin along with the corresponding portion of the user's clothing;

a capture pushbutton integrally formed on an exterior surface of one of the linear arm portions, made and arranged to enable a user to urge the jaw pads together through flexure of the curved portion of the U-shaped main body;

a fixed latch member located between the parallel linear arm portions and extending from one of the linear arm portions to a mid region between the two linear arm portions, the fixed latch member being configured with a first latch tooth pattern including at least one latch tooth located in the mid region;

a flex-mounted latch member, extending from the other linear arm portion, configured with a second latch tooth pattern including at least one latch tooth, made and arranged to engage the first latch tooth pattern, upon user depression of the capture pushbutton to initiate a deployed mode, in a manner to capture and secure together the folded portion of the napkin and the corresponding portion of the clothing between the two jaw pads; and release means, including a user-actuated releasing member disposed on an outer region of the U-shaped main body, enabling the user to release the portion of table napkin from the corresponding portion of the user's clothing.

2. The napkin holding clip as defined in claim 1 wherein said release means comprises a release pushbutton, constituting the releasing member, and associated releasing structure made and arranged to release the jaw pads from the deployed mode when the release pushbutton is depressed by the user, and to thus initiate a standby mode wherein the jaw pads are held separated ready for subsequent deployment.

3. The napkin holding clip as defined in claim 2 wherein the release pushbutton is specially shaped externally and imprinted with graphics of a nature that includes ornamental and promotional matter.

4. The napkin holding clip as defined in claim 2 further comprising an overlay member attached onto the release pushbutton and imprinted with graphics of a nature that includes ornamental and promotional matter.

5. The napkin holding clip as defined in claim 2 wherein said releasing structure comprises;

the flex-mounted latch member being resiliently attached to the associated arm of the main body at a flexure point located close to the associated arm; and a release pushbutton assembly, including the release pushbutton, made and arranged to enable the user, by depressing the release pushbutton, to deflect and unlatch the flex-mounted latch member from the fixed latch member and thus release the jaw pads to separate and thus free the captured napkin and clothing, and thus revert to the standby mode with the jaw pads separated ready for subsequent deployment.

6. The napkin holding clip as defined in claim 1 wherein the first latch tooth pattern is configured with two teeth and the second latch tooth pattern is configured with one tooth, thus providing a choice of two latched positions in the deployed mode.

* * * * *